US005372110A

United States Patent [19]

Boverie et al.

[11] Patent Number: 5,372,110

[45] Date of Patent: Dec. 13, 1994

[54] METHOD AND DEVICE FOR CLOSED-LOOP CONTROL OF THE POWER OF AN INTERNAL COMBUSTION ENGINE PROPELLING A MOTOR VEHICLE

[75] Inventors: Serge Boverie, Plaisance Du Touch; Christian Barreau; Pierre Bidan, both of Toulouse, all of France

[73] Assignee: Siemens Automotive S.A., Toulouse Cedex, France

[21] Appl. No.: 94,104

[22] PCT Filed: Jan. 24, 1992

[86] PCT No.: PCT/EP92/00155

§ 371 Date: Jul. 29, 1993

§ 102(e) Date: Sep. 21, 1993

[87] PCT Pub. No.: WO92/13185

PCT Pub. Date: Aug. 6, 1992

[30] Foreign Application Priority Data

Jan. 29, 1991 [FR] France ..... 91 00955

[51] Int. Cl.[5] ..... F02D 11/10; F02D 41/16

[52] U.S. Cl. ..... 123/339; 123/361

[58] Field of Search ..... 123/361, 399, 339

[56] References Cited

U.S. PATENT DOCUMENTS

| | | | |
|---|---|---|---|
| 4,622,936 | 11/1986 | Junginger et al. | 123/361 X |
| 4,729,356 | 3/1988 | Kaneko et al. | 123/361 |
| 4,763,264 | 8/1988 | Okuno et al. | 123/361 X |
| 4,811,713 | 3/1989 | Shimada et al. | 123/361 X |
| 4,823,749 | 4/1989 | Eisenmann et al. | 123/361 X |
| 4,883,035 | 11/1989 | Shimomura et al. | 123/361 |
| 4,911,259 | 3/1990 | Dogaharz et al. | 123/361 X |
| 4,919,096 | 4/1990 | Manaka et al. | 123/361 X |
| 5,025,380 | 6/1991 | Wataya et al. | 123/361 X |
| 5,031,593 | 7/1991 | Erhard et al. | 123/361 X |
| 5,095,874 | 3/1992 | Schnaibel et al. | 123/361 |
| 5,131,360 | 7/1992 | Muschalik | 123/361 X |
| 5,200,898 | 4/1993 | Yuhara et al. | 123/361 X |

FOREIGN PATENT DOCUMENTS

| | | |
|---|---|---|
| 0204524 | 12/1986 | European Pat. Off. . |
| 0297951 | 1/1989 | European Pat. Off. . |
| 0318467 | 5/1989 | European Pat. Off. . |
| 0445339 | 9/1991 | European Pat. Off. . |
| 55-137325 | 10/1980 | Japan . |
| 59-185853 | 10/1984 | Japan . |

*Primary Examiner*—Willis R. Wolfe

*Attorney, Agent, or Firm*—Herbert L. Lerner; Laurence A. Greenberg

[57] ABSTRACT

According to the invention, a) from the position of an accelerator pedal actuated by the driver, a value is extracted of a power ($P_d$) requested by this driver, b) in various vehicle operating phases, a base power ($P_b$) absorbed by the vehicle over and above the power possibly required to move the latter is calculated, and c) the quantities of air and of fuel admitted into the engine are controlled in such a way as to drive the power ($P_m$) which it delivers to the sum of the requested ($P_d$) and base ($P_b$) powers.

9 Claims, 2 Drawing Sheets

Figure 1:
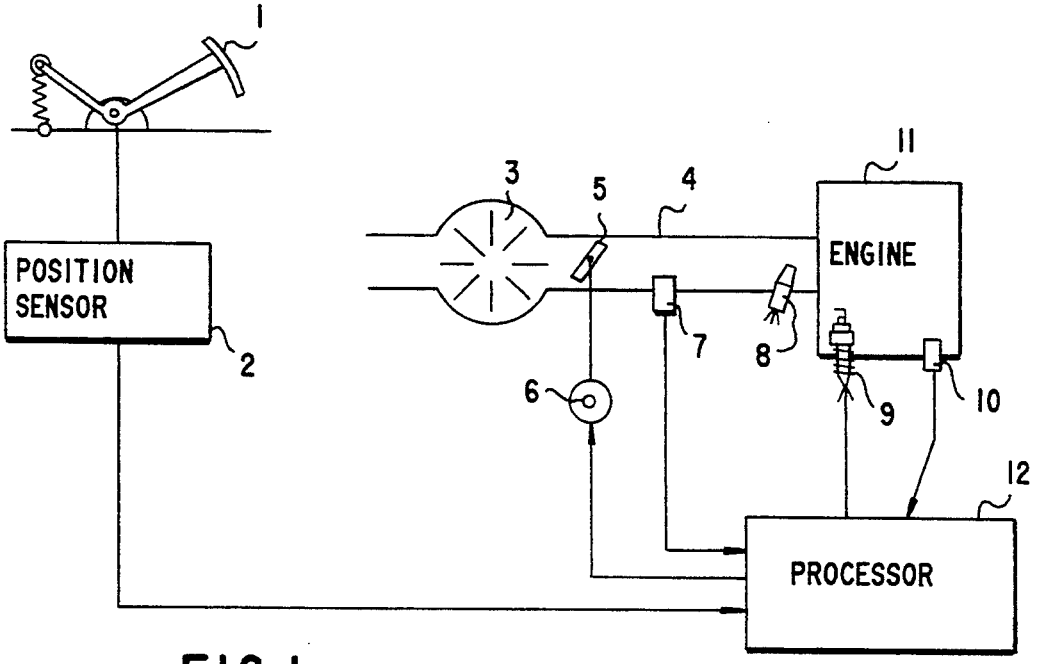

METHOD AND DEVICE FOR CLOSED-LOOP CONTROL OF THE POWER OF AN INTERNAL COMBUSTION ENGINE PROPELLING A MOTOR VEHICLE

The present invention relates to a method and a device for closed-loop control of the power delivered by an internal combustion engine propelling a motor vehicle and, more particularly, to such a method and such a device offering improved resistance to random variations in the engine load.

When the engine is in a critical operating phase (idling speed for example), and if a consumer of power, such as an air conditioner, is switched on, a possible stalling of the engine is prevented, according to a known arrangement, by delaying the setting off of the consumer of power until after the end of the critical phase. Such a solution is not, however, applicable if it affects the safety of the vehicle (the case of the activation of an anti-wheel lock device) or if the disturbance causing the overload is not controllable (gust of wind, approach of a gradient, etc.).

Devices are also known for regulating the engine speed in the idling phase, through servocontrol of the rate of rotation of the engine to a predetermined minimum rate of rotation. This minimum rate must be high enough to enable the engine to overcome the friction and inertia of the rotating masses of this engine, whilst also permitting random load variations (switching on of headlights, engaging of a gear in the gearbox, etc.). The response time of such a servocontrol is relatively long because the speed is a slowly varying variable. Moreover, the actuators used in these servocontrols are either accurate but slow (throttle with idle speed position-regulating tappet), or fast but inaccurate (additional solenoid-controlled valve mounted in parallel with a mechanical throttle). It is also possible to criticise the known idle-regulation devices of the prior art, for the excessively long idle-speed entry times required to avoid speed discontinuities.

For all these reasons, the setpoint speeds used in the regulation of an idle phase are purposely set to an exaggeratedly high value, so as to protect the engine from the risks by stalling upon fluctuations in load. This results in exaggerated fuel consumption and pollution by the exhaust gases which it seems necessary to reduce.

EP-A-318467 discloses a method in which the control of idle-speed of an engine is able to withstand the addition of a load like engaging the "Drive" position of a gearbox without having a too high initial rpm count. With this method, a minimum value of the current to be applied to an idle speed control valve is calculated (Ifb), under specific conditions (idling, with no additional load applied to the engine), with a closed-loop control of the rotational speed. Upon detection of the gearbox being in the "drive" position, an additional term (Iat) is added to this minimum value to cope with the additional load exerted by the gearbox. In an other embodiment of this method, during idling phases under feedback mode, an average value (Ixref) of the integral term of the above minimum value is memorised and used, when the system is not in feedback mode, to keep the idle speed control valve to a minimum opening. However, the method disclosed in EP-A-318467 has some major drawbacks: First, it requires that an information about the added load, i.e. the status (D/N) of the gearbox, is provided to the electronic control unit, which will not be possible if the load to be considered is an external one, and second, as many of the known regulation devices, it is only operational during the idle phase, and outside of this phase it is replaced by open-loop controls which do not permit compensation for load variations.

It will also be noted that those of the idle-regulation devices of the prior art which make use of the additional valve mentioned above, mounted in parallel with the inlet duct conventionally fitted with a throttle for regulating the admission of air, thus comprise two actuators which create complicated problems of matching of control laws when leaving an idle-regulation phase.

The subject of the present invention is therefore to provide a method and a device for controlling the power of an internal combustion engine, which do not have the disadvantages of the known devices mentioned above and which, in particular, make it possible to reduce the sensitivity of the engine to sudden load variations resulting from, for example, outside disturbances.

The present invention also aims to provide such a method and to produce such a device, which ensure regulation of the power of the engine in all its operating phases and not only in the idle phase.

The present invention moreover aims to provide such a control method which is at one and the same time "robust", fast and accurate.

These aims of the invention, as well as others which will emerge on reading the present description, are achieved with a method of closed-loop control of the power delivered by an internal combustion engine propelling a motor vehicle, according to which:

a) a value of the power requested by the driver ($P_d$) is extracted from the position of an accelerator pedal, b) a base powder ($P_b$) absorbed by the vehicle over and above the power possibly required to move the vehicle is calculated in various operating phases, c) a value of the power ($P_m$) of the engine is calculated from the product of the rotational speed ($N_m$) of the engine and of the inlet pressure ($P_a$) of air in engine intake manifold, and d) a control signal ($\phi_c$) for controlling the quantity of air admitted in to the engine is extracted from a dynamic correction of the deviation between the sum (P) of the requested ($P_d$) and base ($P_b$) powers, on the one hand, and the power of the engine ($P_m$), on the other hand.

By virtue of the closed-loop regulation of the power of the engine used in the method following the invention, better stability of operation of this engine is ensured, the fluctuations in the speed of the engine about an operating point are reduced, the accuracy of control is enhanced, and the system is made insensitive to disturbances which create abrupt load variations (switching on of an air conditioner, of headlights, etc.).

Following a characteristic of the method according to the invention, in the vehicle start-up phase or in the engine idling operating phase, the base power ($P_b$) is extracted from a dynamic correction of the deviation between a setpoint speed and the measured speed of the engine. As will be seen below, the level of the speed of the engine during these phases and, consequently, pollution and fuel consumption are thereby reduced.

Following yet another characteristic if the method according to the invention, in the normal operating phase of the engine, the average value of the powers of the engine during a plurality of earlier engine idling operating phases is calculated, and this average value is used as base power ($P_b$).

In order to evaluate the power of the engine, according to the method following the invention, the inlet pressure of air into the engine and the speed of the engine are measured, and a value is established of the power ($P_m$) of the engine from the product of the values of this pressure and of this speed.

A control signal for the quantity of air admitted into the engine is extracted from a dynamic correction of the deviation between the sum of the requested ($P_d$) and base ($P_b$) powers, on the one hand, and the power ($P_m$) of the engine, on the other hand, such as it is evaluated from the product of the inlet pressure times the speed of the engine.

In order to implement the method according to the invention, a device is provided comprising an accelerator pedal and a sensor of the position of this pedal, means of regulating the quantity of air admitted into the engine, a sensor of the pressure of air admitted into the engine, a sensor of speed of the engine, these sensors providing signals to a processor which formulates and delivers control signals to the means of regulating the quantity of air admitted and to fuel injection means. Following the invention, the processor of the device comprises means for calculating, in various operating phases of the vehicle impelled by the engine, a base power ($P_b$) absorbed by the vehicle over and above the power possibly required to move it, means responsive to the signal delivered by the sensor of position of the pedal in order to calculate a power ($P_d$) requested by the driver, means responsive to the signals delivered by the pressure and speed sensors in order to calculate a power ($P_m$) delivered by the engine, and means of controlling the air regulation means and the fuel injection means in order to drive the power ($P_m$) delivered by the engine to the sum of the requested ($P_d$) and base ($P_b$) powers.

Figure 2:
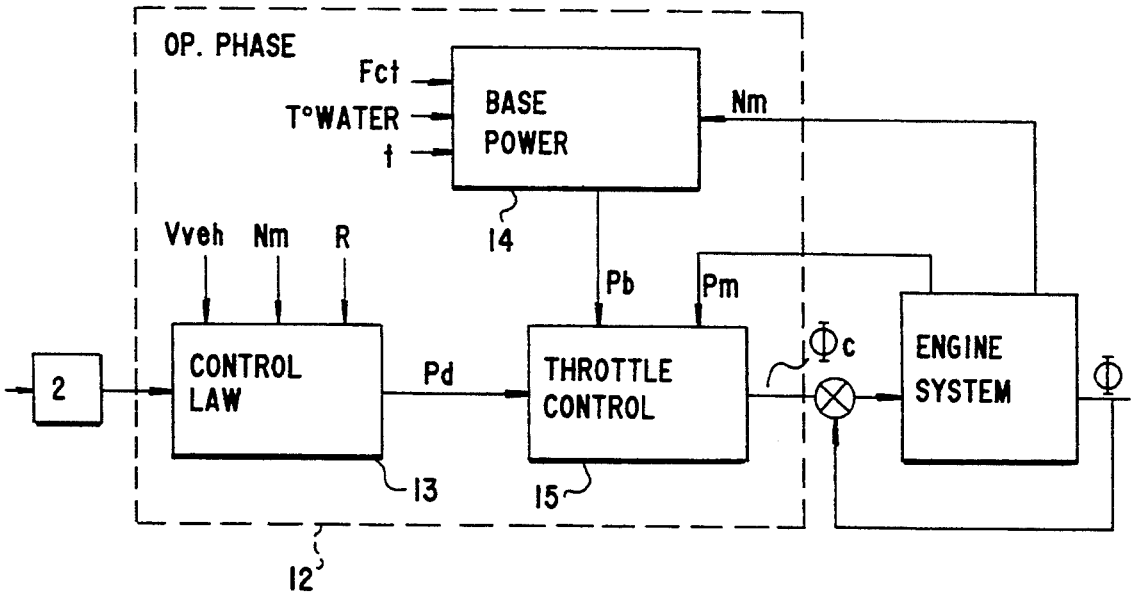
Figure 3:
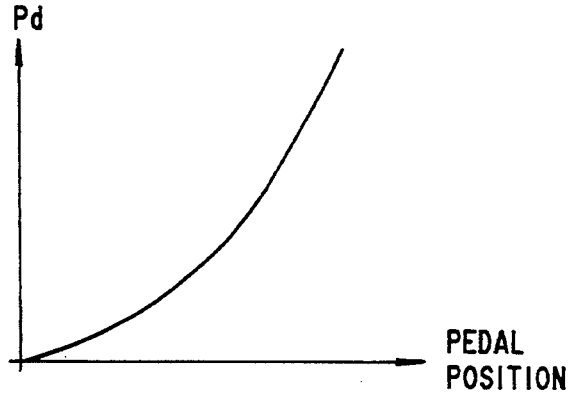
Figure 4:
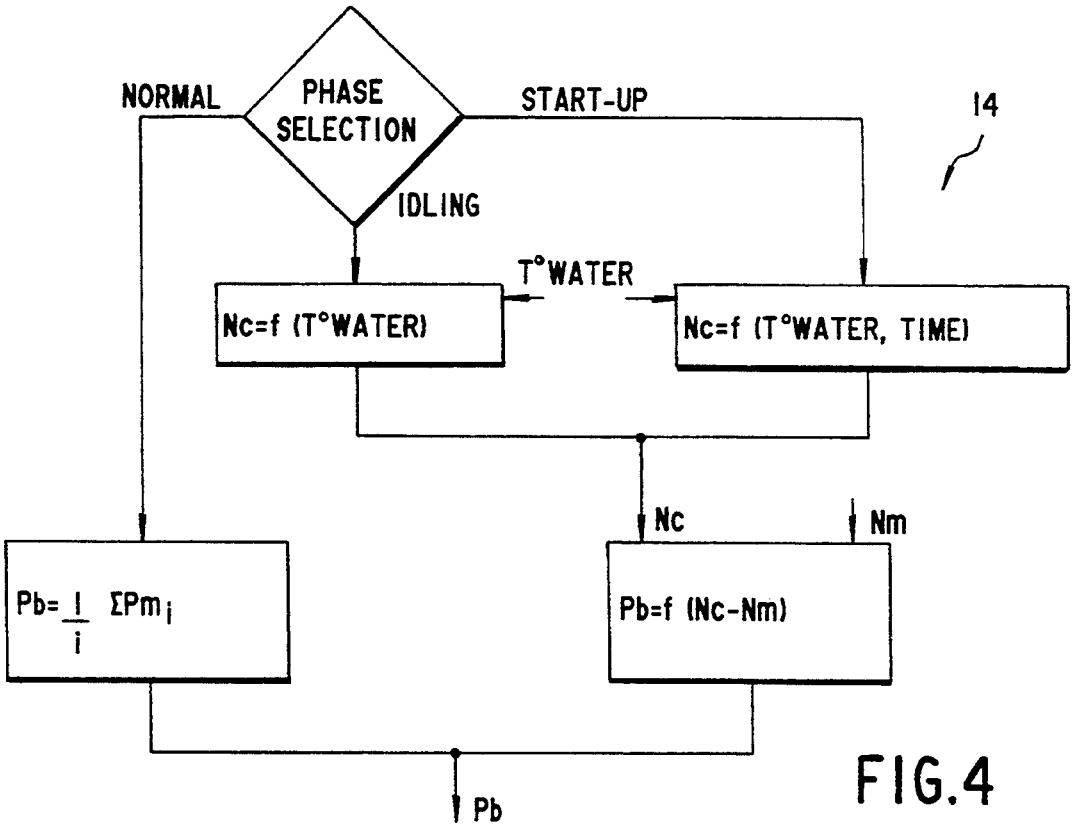
Figure 5:
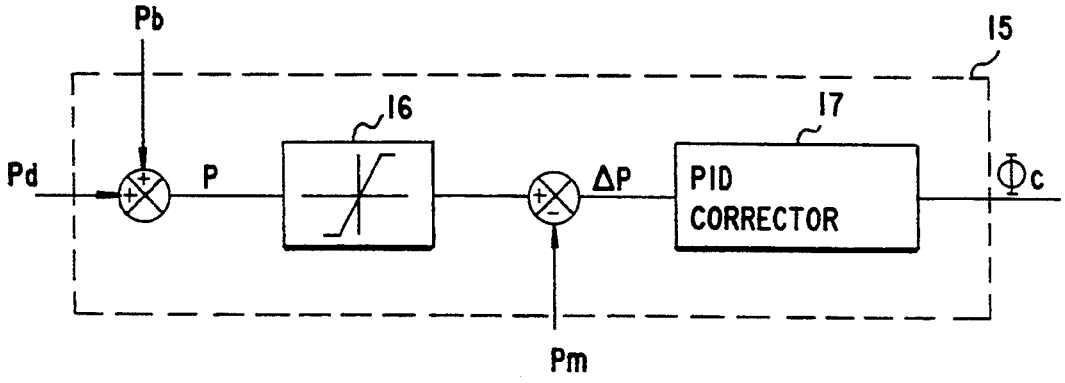

Other features and advantages of the method and of the device following the invention will emerge on reading the description which follows and on examining the attached drawing in which:

FIG. 1 is a diagram of the control device used to implement the method following the invention, FIG. 2 is a functional diagram of the control method following the invention, FIG. 3 is a graph of a control law used to calculate a power requested by the driver from the position of the accelerator pedal, FIG. 4 is a functional diagram of the calculation of the base power used in the method according to the invention, and FIG. 5 is a functional diagram of the power-servocontrol implemented by the control method following the invention.

Reference is made to FIG. 1 of the attached drawing in which it is apparent that this method is implemented with the aid of a device for controlling an internal combustion engine 11 propelling a motor vehicle, this device comprising an accelerator pedal 1 coupled to a position sensor 2 which delivers to a processor 12 a signal representing the position occupied by this pedal, which position reflects a request for power from the engine expressed by the driver of the vehicle. The engine 11 is supplied with air through a filter 3 and an inlet duct 4. The quantity of air entering the engine is regulated by a throttle 5 actuated, for example, by an electric motor 6 controlled by the processor 12. As a variant, these means 5, 6 of regulating the quantity of air admitted into the engine could be replaced by a conventional mechanical throttle and by an additional valve controlled by a solenoid and placed in a duct branched to that part of the duct 4 which contains the mechanical throttle, as is well known in the art. The pressure of air admitted into the engine is measured by a pressure sensor 7 placed in the inlet duct downstream of the throttle 5, this sensor providing the processor 12 with a signal representing this pressure. The processor furthermore controls the opening and closing times of one or more injectors 8 providing fuel to the engine. The rate of rotation, or speed, of the latter is measured by a sensor 10, for example of the magnetic reluctance type, and this sensor provides the processor 12 with a signal representing this speed. The processor can moreover control, as is well known, the sequenced sparking of the plugs 9 placed in the cylinders of the engine.

The processor conventionally comprises one or more microprocessors associated with peripheral elements such as memories, analogue converters, signal shapers and actuator-control circuits. Such a microprocessor can be programmed so as to control admission of air, injection of fuel and/or sparking, following one or more specified strategies. The control method according to the invention is based on such a strategy duly programmed into the processor. The programming of this strategy, with the aid of the description which follows of the control method according to the invention, is within the domain of the usual expertise of a programmer. It will therefore not be detailed below.

With reference to the functional diagram of FIG. 2, it is apparent that, following the control method according to the invention, the processor 12 establishes a power $P_d$ requested by the driver, from the signal provided by the sensor 2 of pedal position and from a transformation of this signal with the aid of a specific control law (block 13) which will be specified below.

Furthermore, the processor formulates a base power $P_b$ corresponding to the minimum power which the engine must deliver in order to avoid, for example, stalling due to the absorption of greater power by friction internal to the engine, by a fan, an alternator etc. driven by the engine. This base power may also be calculated so as to absorb a random load such as that which results from turning on an air conditioner and which could also, at idle speed for example, cause the engine to stall. As illustrated in block 14 of the diagram of FIG. 2, this base power is a function of the operating phase which the engine is in. In this regard, following the invention, three principal phases can be distinguished: start-up, idling, normal operation. The power is also a function of the temperature of the engine cooling water, of the measured speed $N_m$ of this engine and, in the start-up phase, of the time elapsed since the starting of the vehicle.

The quantity of air entering the engine is regulated, as seen above, by the throttle 5 actuated by the motor 6 itself controlled by the controller 12. The angle of opening $\phi c$ of the throttle is then calculated by a controller (block 15) from requested and base powders $P_d$ and $P_b$ respectively , which are delivered by block 13 and 14 respectively. Following an essential feature of the method according to the invention, control of the opening of the throttle by the controller 15 is performed in closed loop, the power $P_m$ delivered by the engine being driven to the sum ($P_d+P_b$) of the, respectively, requested and base powers. In the functional diagram of FIG. 2 there appears a second loop for servocontrolling the true angle of opening $\phi$ of the throttle to the calculated angle $\phi_c$, a servocontrol which is known per se in electrically controlled throttles.

Of course, the processor also comprises means for calculating the time of opening of the injectors 8 as a function of the quantity of air entering the engine, which quantity is itself known to the processor from the signal delivered by the inlet pressure sensor 7 and from the measured engine speed $N_m$. These means are conventional and will not therefore be described below.

Reference is now additionally made to FIG. 3 in order to explain in greater detail the procedure for formulating, by the processor, the power $P_d$ requested by the driver. By way of example, the transfer function of a control law implemented in block 13 of the diagram of FIG. 2 has been represented in FIG. 3. This transfer function can be, for example, of generally parabolic shape and relate the requested power to the pedal position alone. For ergonomic reasons taking into account comfort and pollution criteria, the use can be envisaged of more complicated control laws relating the requested power not only to the pedal position but also to the engine speed $N_m$. The graph of FIG. 3 would then be replaced by a group of curves each associated with a particular engine speed. Even more complicated laws could be envisaged, additionally taking into account the velocity $V_{veh}$ of the vehicle and the step-down ratio R engaged, for example. Provision can also be made to limit the change in requested power so as to regularise the behaviour of the vehicle and reduce the emission of polluting gases in the acceleration phases for example.

Reference is now made to the functional diagram of FIG. 4 in order to detail the strategy implemented by the processor in order to determine the base power $P_b$. Following this strategy, account is firstly taken of the operating phase which the engine is in, that is to say a normal operating phase, an idling operating phase, or a vehicle start-up phase.

In normal operation, following a mode of implementation of the invention given merely by way of example, the processor extracts the power $P_b$ from a calculation of the average of the powers of the engine observed during earlier stable idle operating phases. This average power can be expressed by the relationship:

$$P_b = \frac{1}{i} \Sigma P_{mi}$$

where $P_{mi}$ is the average power during a stable idle phase of order i.

Another expression for an average power which lends itself to recursive updating by the processor is such that:

$$P_{b(j+1)} = P_{bj} + k \cdot P_{b(j+1)}$$

with $\overline{P}_{b(j+1)}$ and $\overline{P}_{bj}$, global average powers, fixed in the stable idle-regulation phases of order j+1 and j respectively, and $P_{b(j+1)}$, instantaneous power measured during the stable idle-regulation phase of order j+1.

An idle-regulation phase is defined as stable if the engine speed is contained, for a sufficiently long predetermined time, within a defined domain around the setpoint engine speed. It will be explained below how the method following the invention operates in order to define a setpoint engine speed $N_c$ during an idle phase.

As seen above, the control method following the invention calls upon a measurement or a calculation of the engine power $P_m$. To do this, the processor exploits the signals delivered by the sensors 7 and 10 of inlet pressure $p_a$ and of engine speed $N_m$. Advantageously, the pressure $p_a$ is measured at each top dead centre point. Following the invention, the engine power $P_m$ is evaluated simply from the product $k.p_a.N_m$ (where k is a constant inherent to the engine) which can be identified as a first approximation to this power delivered by the engine $P_m$ even though this is not strictly exact. Use of the product $k.p_a.N_m$ offers the advantage of correcting the slow variation in the speed $N_m$ with a rapidly varying parameter ($p_a$). The action of the parameter $p_a$ can broadly be likened to that of a derivative, this action enabling the processor to follow most closely the load variations of the engine and therefore to correct accordingly the power which it must deliver.

We return to the functional diagram of FIG. 4 in order to detail the strategies for calculating the base power, which are implemented by the processor of the device following the invention, in the idle phase or in the start-up phase of the engine. Following these strategies, a setpoint speed $N_c$ is firstly determined for the engine. In the idle phase this setpoint speed is conventionally a function of the temperature $T°_{water}$ of the engine cooling water. In the start-up phase this setpoint speed is furthermore a function of the time which has elapsed since the starting of the vehicle. In both cases the setpoint speeds are tabulated and stored in memories provided for this purpose in the processor.

The setpoint speed $N_c$ being determined as indicated above, the base power is calculated, following an advantageous feature of the method according to the invention, through a dynamic correction of the deviation:

$$\Delta N = N_c - N_m$$

between the setpoint speed $N_c$ and the measured speed $N_m$.

This dynamic correction can be of the PID type and the base power $P_b$ can then be expressed in the form:

$$P_b = K_I \cdot \int \Delta N + K_P \cdot \Delta N + K_D \cdot \Delta N$$

with $K_I$, $K_P$, $K_D$, coefficients depending on the temperature of the cooling water, and established by test-bench measurements on the engine.

A conventional, hardware or software PID controller incorporated in the processor 12, thus delivers this base power $P_b$.

Of course, other types of dynamic corrections could be used to impart a given stability and a given dynamic range to the device according to the invention.

By proceeding as indicated above, the idle speed $N_c$ can be set at a value much lower than that commonly used, which is overevaluated as seen above in order to avoid any stalling of the engine in the event of a random overload, this being to the detriment of the fuel consumption and of the "cleanness" of the engine.

As represented in the diagram of FIG. 5, the processor adds together this base power $P_b$ and the power $P_d$ requested by the driver, as corrected by the control law of FIG. 3, in order to extract therefrom a total power $P = P_b + P_d$ to which the processor drives the power $P_m$ of the engine, evaluated as indicated above. Advantageously, the power P is processed in a saturator 16 which limits the rate of change of the power in the transient phases. Again advantageously, the deviation:

$$\Delta P = P - P_m$$

is the subject of a correction in a dynamic corrector 17 of the PID type for example. The setpoint opening angle $\Phi_c$ of the throttle is then expressed in the form:

$$\Phi_c = K'_P \cdot \Delta P + K'_I \cdot \int_T \Delta P + K'_D \cdot {}'\Delta P$$

T being the sampling period for the measurements and for the calculation, and the coefficients $K'_P$, $K'_I$, $K'_D$ being adjusted like the coefficients $K_P$, $K_D$, $K_I$ mentioned above.

The method of closed-loop control of the power of an internal combustion engine described above offers various advantages. A closed-loop control strategy makes it possible to improve the "robustness" of the control, that is to say its insensitivity to disturbances, to ensure a short response time (with widening of the pass band) and good accuracy, the calculations carried out appertaining to deviations.

Moreover, the use of an actuator, the electrically controlled throttle 5, itself positionally driven by means integrated with the actuator, contributes to the achievement of a large dynamic range and a short response time.

Furthermore, and essentially, the "power" parameter used in the method following the invention clearly reflects the state of the engine in that it combines a rapidly changing parameter, the inlet pressure, with a slowly changing parameter, the engine speed.

We claim:

1. A method of closed-loop control of a power delivered by an internal combustion engine propelling a motor vehicle, which comprises:

a) extracting a value of an engine power requested by a driver of the vehicle from a position of an accelerator pedal, b) calculating, in various operating phases, a base power consumed by the vehicle over and above a power possibly required for moving the vehicle, c) measuring a rotational speed of the engine and measuring an air inlet pressure in an intake manifold of the engine, and calculating a value of an engine power from a product of the rotational speed and the inlet pressure, and d) adding the requested power and the base power to form a power sum, forming a dynamic correction of a deviation between the power sum and the engine power, and extracting a control signal for controlling a quantity of air admitted into the engine from the dynamic correction of the deviation.

2. The method according to claim 1, which comprises, in a vehicle start-up phase, extracting the base power from a dynamic correction of a deviation between a setpoint speed and the measured rotational speed of the engine.

3. The method according to claim 1, which comprises, in a normal operating phase of the engine, calculating an average value of engine power conditions during a plurality of engine idling operating phases, and calculating the base power from the average value of engine power conditions.

4. The method according to claim 3, which comprises using only stable idling phase values in calculating the average value of engine power conditions.

5. The method according to claim 1, which comprises saturating the power sum of the requested power and the base power.

6. The method according to claim 1, which comprises, in an engine idling phase, extracting the base power from a dynamic correction of a deviation between a setpoint speed and the measured rotational speed of the engine.

7. In a motor vehicle with an internal combustion engine propelling the motor vehicle and an accelerator pedal through which a driver requests a power output from the engine, a device for closed-loop control of the power delivered by the internal combustion engine, comprising:

accelerator sensor means operatively connected to the accelerator pedal for sensing a position of the pedal corresponding to a request for power by the driver, air regulating means for regulating a quantity of air admitted into the engine, air pressure sensor means disposed in an air inlet to the engine for measuring an air pressure admitted into the engine, rpm sensor means for ascertaining a rotational speed of the engine, a processor connected to and receiving signals from said accelerator sensor means, said air pressure sensor means and said rpm sensor, said processor including:

means for formulating and feeding control signals to said air regulating means and to an engine fuel injection;

means for calculating, in various operating phases of the motor vehicle, a base power consumed by the motor vehicle over and above a power possibly required to move the motor vehile, means responsive to a signal received from said accelerator sensor means for calculating the power requested by the driver, means responsive to signals received from said air pressure sensor means and said rpm sensor means for calculating an engine power from a product of the rotational speed and the air pressure, means responsive to a deviation between a sum of the power requested by the driver and the base power, and the engine power for generating a control signal, and means for regulating the quantity of air entering the engine in response to said control signal.

8. The device according to claim 7, wherein said means for regulating the quantity of air entering the engine include a throttle, an electric motor for actuating said throttle, and electrical connecting means between said throttle and said processor.

9. The device according to claim 7, wherein said means for regulating the quantity of air entering the engine include a mechanically actuated throttle, a valve branched into an air inlet duct of the engine, and an operative connection between said processor and said valve.

* * * * *